US005381326A

United States Patent [19]

Yeh

[11] Patent Number: 5,381,326

[45] Date of Patent: Jan. 10, 1995

[54] FLOOR LAMP STRUCTURE

[76] Inventor: John Yeh, 600 Aberdeen, Aneheim Hills, Calif. 90266

[21] Appl. No.: 26,836

[22] Filed: Mar. 5, 1993

[51] Int. Cl.[6] ..... F21S 1/12

[52] U.S. Cl. ..... 362/414; 362/431

[58] Field of Search ..... 362/414, 431

[56] References Cited

U.S. PATENT DOCUMENTS

| | | | |
|---|---|---|---|
| 839,869 | 1/1907 | Muschenheim | 362/414 |
| 4,228,489 | 10/1980 | Martin | 362/414 |
| 4,775,922 | 10/1988 | Engel | 362/414 |
| 5,016,154 | 5/1991 | Leeyeh | 362/414 |

*Primary Examiner*—Carroll B. Dority
*Attorney, Agent, or Firm*—Francis X. LoJacono

[57] ABSTRACT

A floor lamp structure having a vertical support post defined by an upper frame section and a lower frame section which are adapted to be removably attached to each other, wherein the first frame section includes an upper lamp fixture connecting end on which a lamp fixture is mounted and a lower frame connecting end, and wherein the lower frame section is formed having an upper frame connecting end that attaches to the lower frame connecting end of the upper frame section and a lower mounting end which is arranged to be attached to a base member.

4 Claims, 1 Drawing Sheet

10
12
14
16
18
20
21
22
24
26
27
28
30
30a
32
34
36
38
40
42
43
44
45
46
47
48
50
52
54
55
56
58
60
62
64

FLOOR LAMP STRUCTURE

BACKGROUND OF THE INVENTION

The present invention relates to a floor lamp and more particularly to a vertical support structure of the floor lamp. The vertical support structure is formed having two frame sections removably connected to each other to define the full length upright support structure when secured together to support a lamp fixture at one end and to be mounted to a base member at the other end.

Many types and configurations of floor lamps are presently in use. However, the support structures of these lamps often have features that restrict their use, particularly those floor lamps that are provided with a single upright frame or post. They are often impractical to ship due to their extreme lengths that vary from five to seven feet. The shipping containers presently in use for floor lamps are sized to readily receive and protect all the pares of a floor lamp and thus posing a shipping problem due to their large size and configuration. Such large sized containers, however, require more shipping room and thus transportation by snip or truck becomes very costly as a high volume of unused space is created. Accordingly, the shipper is paying for the excess unused space.

SUMMARY OF THE INVENTION

The present invention comprises a novel arrangement wherein at least two longitudinal frame sections define a single upright lamp structure when assembled after removing the two sections from their shipping container. The pair of longitudinal frame sections are adapted to be secured together at a central intermediate point between their respective outer ends. Such an arrangement allows the shipping container to be constructed in the standard length of approximately four feet.

Thus, the present invention has for an important object a provision wherein an upright lamp support structure can be stored in a standard shipping container of approximately four feet in a disassembled mode. The two half-length frame sections are unassembled when shipped and are then assembled after reaching their destination or later when sold by the purchaser while still in the shipping container. Such a small shipping container also allows a purchaser of the disassembled floor lamp to take the floor lamp at the time of purchase. At present a similar size floor lamp must be delivered by the store in which it is bought.

Still another object of the invention is to provide a floor lamp structure, as indicated, wherein a lamp fixture is readily mounted to the upper lamp mounting crossbar and the base member is adapted for mounting to the lower mounting crossbar.

It is still another object of the present invention to provide a novel two-section vertical support structure of this character wherein the frame sections are formed from tubular members and, more particularly, rectangular or square tubular members that are arranged not only as a means to support the light fixture of the lamp but to provide a means by which electrical wiring of the fixture can be disposed within the tubular members of the two sections.

It is still a further object of the present invention provided a floor lamp of this character whereby two sections, the lamp fixture and base mender, are easily assembled with the use of only a screwdriver.

Yet another object of the invention is to provide a floor lamp of this character having two sections which include simple securing end members that are readily adaptable for use with a support structure of any suitable configuration compatible with any design of lamp fixture and base member.

The characteristics and advantages of the invention are further sufficiently referred to in connection with the accompanying drawings, which represents one embodiment. After considering this example, skilled persons will understand that variations may be made without departing from the principles disclosed: and I contemplate the employment of any structures, arrangements or modes of operation that are properly within the scope of the appended claims.

BRIEF DESCRIPTION OF THE DRAWINGS

With the above and related objects in view, the invention consists in the details of construction and combination of parts, as will be more fully understood from the following description, when read in conjunction with the accompanying drawings and numbered parts.

DESCRIPTION OF THE PREFERRED EMBODIMENT

Figures 1, 2, 3, 4:
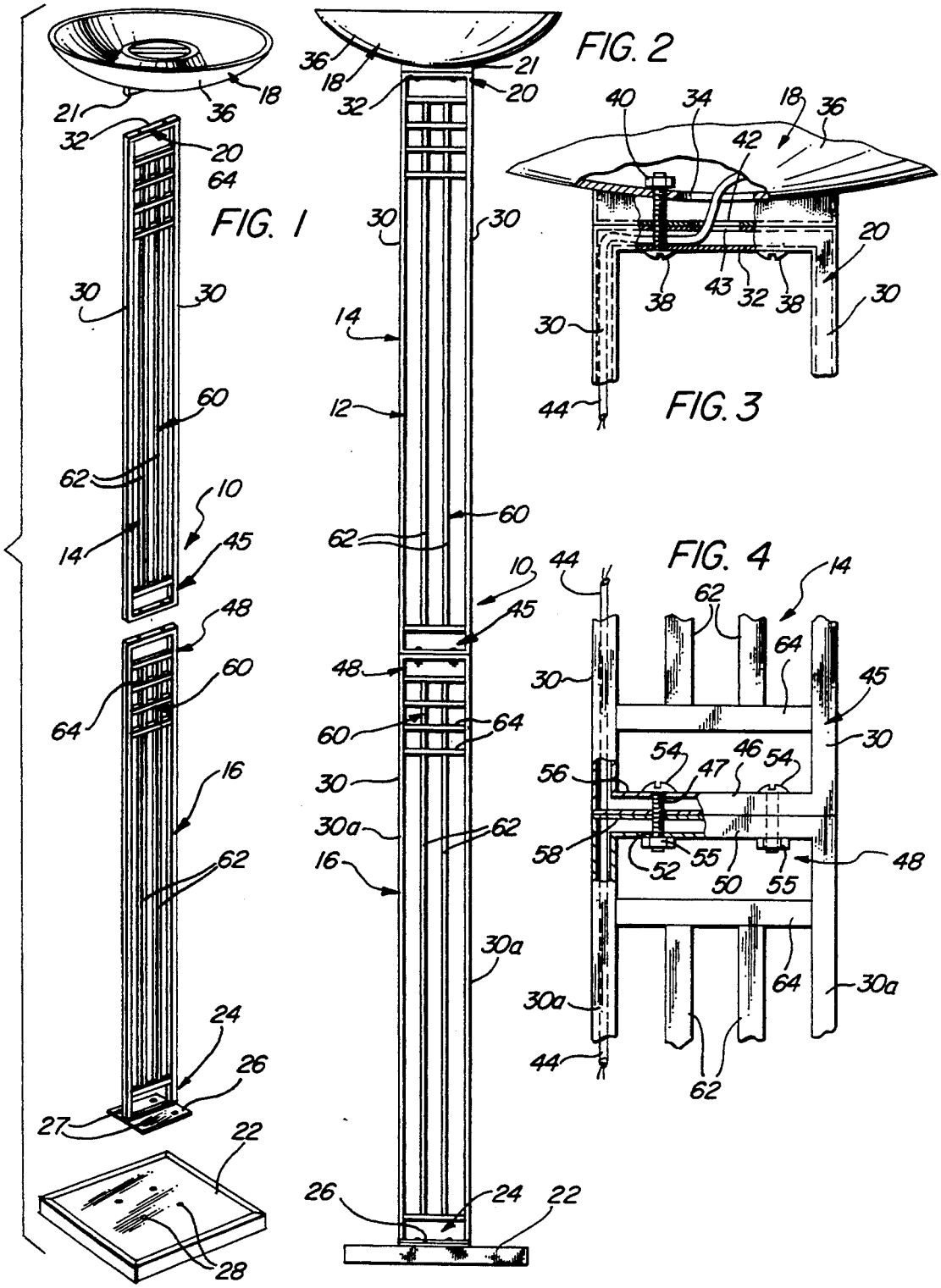
FIG. 1 is an exploded perspective view of an arrangement of a floor lamp wherein the upright support structure is defined by a pair of support frame sections having compatible connecting end members.
FIG. 2 is a front elevational view thereof shown in its assembled configuration mounted to a light fixture and a base member.
FIG. 3 is an enlarged view of the upper connecting end of the upper frame section connected to the light fixture.
FIG. 4 is an enlarged view of the central connecting assembly which includes the connecting members of the two frame sections.

Referring more particularly to FIGS. 1 and 2, there is shown a floor lamp, generally indicated by numeral 10, having a floor lamp structure that defines an upright post or column 12 constructed as two support frame sections 14 and 16. In FIG. 1 the two frame sections 14 and 16 are shown separated from each other, and with a suitable lamp fixture 18 spaced above an upper connecting end 20 of the first or upper support frame section 14 adapted to be attached to the underside of lamp fixture 18 which is provided with an oblong mounting bar 21. A base member 22 is positioned below a securing end 24 of the second or lower support frame section 26 and includes mounting holes 27. Securing end 24 of lower support frame 26 is provided with a mounting plate 26 that is affixed by suitable means to securing end 24. Mounting plate 26 is provided with a plurality of holes 27 to receive screws so as to be fastened in threaded holes 28 located in base member 22, as seen in FIG. 1. In FIG. 2 the floor lamp 10 is illustrated in a fully assembled mode wherein the two frame sections 14 and 16 are secured to each other. Lamp fixture 18 is attached to the upper connecting end 20 and the lower frame section is fixedly mounted on base member 22. Each of the frame sections is formed in a very similar manner to the other with the exception of the mounting plate which is positioned at the lower end of the second frame section 16. Frame section 14 is formed with a pair of oppositely disposed vertical bar members 30 that are spaced apart from each other to define the outer side perimeter of the frame member. The outer bar members are interconnected by means of an upper transverse tubular strut member 32 that defines the upper connecting end 20. As can be seen in FIG. 3, oblong mounting bar 21 is suitably attached over opening 34 of bowl 36 that defines part of lamp fixture 18. Mounting bar 21 is affixed to strut member 32 by means of bolts 38 and nuts 40. Both mounting bar 21 and tubular strut 32 are provided with aligned openings 42 and 43, respectively. These openings allow for the electrical conduit 44 to pass from the lamp fixture into and through one of the outer tubular side bar members 30.

Referring now to FIG. 4, there is illustrated an enlarged view of the connection between the upper and lower frame sections 14 and 16. The lower connecting end 45 of upper frame section 14 includes a transverse strut member 46 that is affixedly attached between the lower end of each side bar member 30 and is provided with a pair of aligned mounting holes 47. The upper connecting end 48 of the lower frame section 16 is also formed with a transverse strut member 50 that is positioned between the oppositely disposed outer side bar members 30*a*. The transverse strut member 50 is also provided with a pair of mounting holes 52 which are aligned with holes 47 of transverse bar 46. Here too, the abutting bar members 46 and 50 are connected by suitable securing means such as bolts 54 and nuts 55. The abutting wall members 56 and 58 of the respective bar members 46 and 50 are also provided with matching holes (not shown) that allow electrical conduit 44 to extend down to the base member 22.

As it can be seen, each frame section is provided with an intermediate design structure, indicated generally at 60. The design is shown as a plurality of vertical bar 62 and horizontal bars 64 interposed between vertical bars 30. It should be noted that various design configurations can be positioned within the peripheral structure of the outer bar members 30 and 30*a*.

It may thus be seen that the objects of the present invention set forth herein, as well as those made apparent from the foregoing description, are efficiently attained, While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A floor lamp structure comprising:

a support post defined by a first frame section and a second frame section, wherein said first and second frame sections are removably attached to each other;

said first frame section including an upper light fixture connecting end and a lower frame connecting end;

said second frame section including an upper frame connecting end formed to be removably attached to the lower frame connecting end of said first frame section and a lower base connecting end;

a light fixture removably attached to said upper light fixture connecting end;

a base member removably attached to said lower base connecting end;

means for removably attaching said light fixture to said upper light fixture connecting end;

means for removably attaching said lower connecting end of said first frame section to said upper frame connecting end of said second frame section;

means for removably attaching said lower base connecting end of said second frame section to said base member; said first frame section being defined by a first pair of elongated tubular side bar members; said upper light fixture connecting end and said lower frame connecting end being fixedly mounted between said first pair of elongated tubular bar members; said second frame section being defined by a second pair of elongated tubular side bar members, said upper frame connecting end and said lower base connecting end being fixedly mounted between said second pair of elongated tubular side bar members; and wherein said upper light fixture connecting end is defined by a first transverse tubular strut in which is formed said means for removably attaching said light fixture thereto;

said lower frame connecting end is defined by a second transverse tubular strut in which is formed said means for removably attaching said lower connecting end of said first frame section to said upper frame connecting end of said second frame section; and said lower base connecting end of said second frame section is defined by a mounting plate affixed to the second pair of elongated bar members of said lower frame section.

2. The floor lamp fixture as recited in claim 1, wherein said means for removably attaching said light fixture to said upper light fixture connecting end comprises a plurality of aligned mounting holes formed in said first tubular strut and fastening means positioned in said mounting holes.

3. The floor lamp fixture as recited in claim 2, wherein said means for removably attaching said first frame section to said second frame section comprises a plurality of aligned mounting holes formed in said lower connecting strut of said first frame section and a plurality of matching aligned holes formed in said upper connecting strut of said second frame section, and includes fastening means mounted in the respective aligned holes of said lower connecting bar and said upper connecting strut.

4. The floor lamp fixture as recited in claim 3, including an intermediate structure having a selected design configuration positioned between said first and second pairs of elongated tubular side bar members.

* * * * *